US010247444B2

(12) United States Patent
Krupo et al.

(10) Patent No.: US 10,247,444 B2
(45) Date of Patent: Apr. 2, 2019

(54) FURNACE AND METHOD FOR HEATING AIR

(71) Applicant: Modine Manufacturing Co., Racine, WI (US)

(72) Inventors: Mark Krupo, New Berlin, WI (US); Amit Ingle, Racine, WI (US)

(73) Assignee: MODINE MANUFACTURING COMPANY, Racine, WI (US)

( * ) Notice: Subject to any disclaimer, the term of this patent is extended or adjusted under 35 U.S.C. 154(b) by 872 days.

(21) Appl. No.: 14/554,391

(22) Filed: Nov. 26, 2014

(65) Prior Publication Data

US 2015/0153070 A1 Jun. 4, 2015

Related U.S. Application Data

(60) Provisional application No. 61/911,240, filed on Dec. 3, 2013.

(51) Int. Cl.

| | |
|---|---|
| ***F24H 3/00*** | (2006.01) |
| ***F24H 9/00*** | (2006.01) |
| ***F24H 3/08*** | (2006.01) |
| ***F28D 7/08*** | (2006.01) |
| ***F28D 7/16*** | (2006.01) |
| *F24H 9/02* | (2006.01) |
| *F28F 1/32* | (2006.01) |

(52) U.S. Cl.

CPC ..... *F24H 3/00* (2013.01); *F24H 3/087* (2013.01); *F24H 9/0063* (2013.01); *F28D 7/087* (2013.01); *F28D 7/1615* (2013.01); *F24H 9/02* (2013.01); *F28F 1/32* (2013.01)

(58) Field of Classification Search

CPC ..... F24H 3/00; F24H 3/087; F24H 9/0063
USPC ..... 126/112, 117; 165/103, 165/DIG. 109–DIG. 122
See application file for complete search history.

(56) References Cited

U.S. PATENT DOCUMENTS

| | | | | |
|---|---|---|---|---|
| 4,040,477 | A * | 8/1977 | Garberick | F24F 12/002 165/103 |
| 4,926,840 | A * | 5/1990 | Shellenberger | F23L 17/005 126/110 R |
| 5,437,263 | A * | 8/1995 | Ellingham | F24H 3/105 126/110 AA |
| 5,562,089 | A * | 10/1996 | Astle, Jr. | F23L 15/02 126/110 R |

(Continued)

*Primary Examiner* — Vivek K Shirsat
(74) *Attorney, Agent, or Firm* — Michael Best & Friedrich LLP; Jeroen Valensa; Michael Bergnach

(57) ABSTRACT

A furnace for heating air includes a primary heat exchanger and a secondary heat exchanger to transfer heat from a flow of hot gases, the secondary heat exchanger being arranged downstream from the primary heat exchanger. A collection/discharge box fluidly couples an outlet of the primary heat exchanger and an inlet of the secondary heat exchanger. An enclosure houses the primary heat exchanger, the collection/discharge box, and the secondary heat exchanger, and includes an air inlet and an air outlet. A main air flow path extends through the enclosure from the air inlet to the air outlet, and the primary and secondary heat exchangers are arranged along the main air flow path. An air bypass channel is arranged to be fluidly parallel to a section of the main air flow path, and the collection/discharge box is arranged along the bypass channel.

19 Claims, 7 Drawing Sheets

(56) References Cited

U.S. PATENT DOCUMENTS

| | | | |
|---|---|---|---|
| 6,564,794 | B1 | 5/2003 | Zia et al. |
| 6,732,728 | B2 | 5/2004 | Hill et al. |

* cited by examiner

FURNACE AND METHOD FOR HEATING AIR

CROSS-REFERENCE TO RELATED APPLICATIONS

This application claims priority to U.S. Provisional Patent Application No. 61/911,240, filed Dec. 3, 2013, the entire contents of which are hereby incorporated by reference.

BACKGROUND

The present invention relates generally to a furnace that is utilized to heat a flow of air.

Furnaces can be used to heat a flow of air using hot gases that are the products of combustion. The air to be heated is typically drawn or blown through the furnace and over the outer surfaces of one or more heat exchangers housed within the furnace. The hot gases are routed through the internal channels of the heat exchangers, so that the desired transfer of heat from the hot gases to the air flow is achieved.

Inefficiencies in the transfer of heat between the hot gases and the air flow are known to occur as a result of a portion of the air flow bypassing the heat exchanger or heat exchangers. Such an undesirable air bypass can be exacerbated by the need to space the hot components of the heat exchangers away from the outer walls of the furnace enclosure in order to ensure that the external temperatures of the enclosure do not exceed a safe threshold, thereby creating a relatively unobstructed gap between the heat exchanger and the enclosure wall through which a portion of the air can flow. This problem has been previously addressed through the inclusion of air baffles to direct the air flow through the heat exchanger. Such solutions can cause the required size of the furnace enclosure to increase in order to accommodate the air baffles.

SUMMARY

In one embodiment, the invention provides a method of heating air using hot gases. The method includes the steps of directing the hot gases through a primary heat exchanger, receiving the hot gases from the primary heat exchanger into a collection/discharge box, and directing the hot gases from the collection/discharge box through a secondary heat exchanger. A flow of air is received into a furnace enclosure housing the primary heat exchanger, the collection/discharge box, and the secondary heat exchanger. A portion of the air is diverted through a bypass channel to bypass at least a portion of the primary heat exchanger and the secondary heat exchanger. The diverted air is passed over the collection/discharge box to receive heat from the hot gases within the collection/discharge box, and the un-diverted air is passed over the primary and secondary heat exchanger to receive heat form the hot gases flowing through the heat exchangers. The heated diverted air and the heated un-diverted air are recombined, and the recombined air is removed from the furnace enclosure.

In some embodiments, the diverted air is passed over at least a portion of the primary heat exchanger after having been re-combined with the un-diverted air.

In another embodiment the invention provides a furnace for heating air. The furnace includes a primary heat exchanger and a secondary heat exchanger to transfer heat from a flow of hot gases, the secondary heat exchanger being arranged downstream from the primary heat exchanger. A collection/discharge box fluidly couples an outlet of the primary heat exchanger and an inlet of the secondary heat exchanger. An enclosure houses the primary heat exchanger, the collection/discharge box, and the secondary heat exchanger, and includes an air inlet and an air outlet. A main air flow path extends through the enclosure from the air inlet to the air outlet, and the primary and secondary heat exchangers are arranged along the main air flow path. An air bypass channel is arranged to be fluidly parallel to a section of the main air flow path, and the collection/discharge box is arranged along the bypass channel.

In some embodiments the furnace includes a dividing plate located within the enclosure. The dividing plate separates the bypass channel from the main air flow path. In some embodiments, apertures extend through the dividing plate to fluidly join the bypass channel and the main air flow path. In some such embodiments at least some of the apertures are provided at a location along the main air flow path between the air inlet and at least one of the primary and secondary heat exchangers. In some embodiments at least some of the apertures are provided at a location along the main air flow path between the air outlet and at least one of the primary and secondary heat exchangers.

DETAILED DESCRIPTION

Before any embodiments of the invention are explained in detail, it is to be understood that the invention is not limited in its application to the details of construction and the arrangement of components set forth in the following description or illustrated in the accompanying drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The invention is best understood with reference to FIGS. 1A through 3, which show a furnace 1 adapted to heat a flow of air 37 passing there through. The air 37 receives heat from hot gases as it passes through the furnace 1, and can subsequently be used for space heating or other purposes that require a flow of heated air. The furnace 1 can, for example, be used as a duct furnace within a building heating system. In the exemplary furnace 1 of FIGS. 1A through 3, the hot gases are produced through the combustion of a fuel source, wherein the combustion products are contained within the hot gases. In some other embodiments, the hot gases could be produced by other means.

Figure 1A:
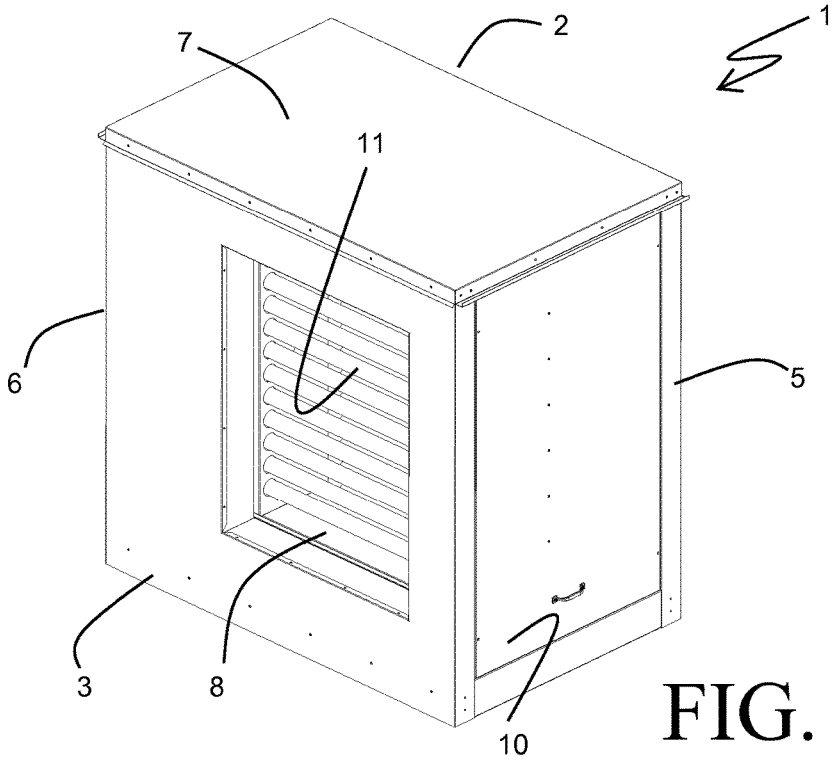
FIGS. 1A and 1B are perspective views of a furnace according to an embodiment of the invention.
Figure 1B:
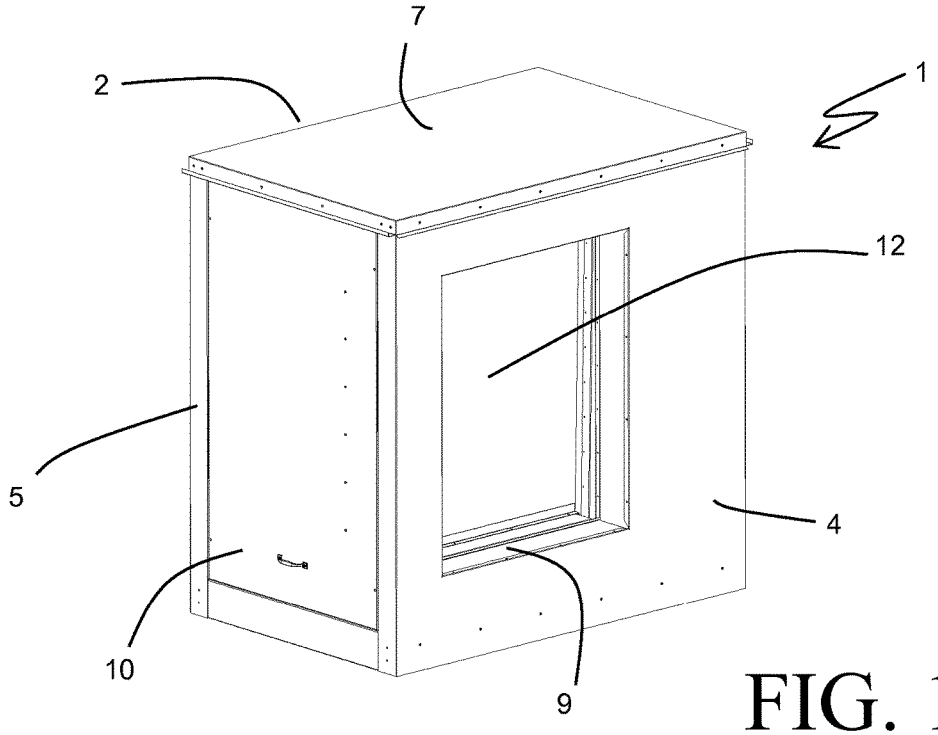
Figure 2:
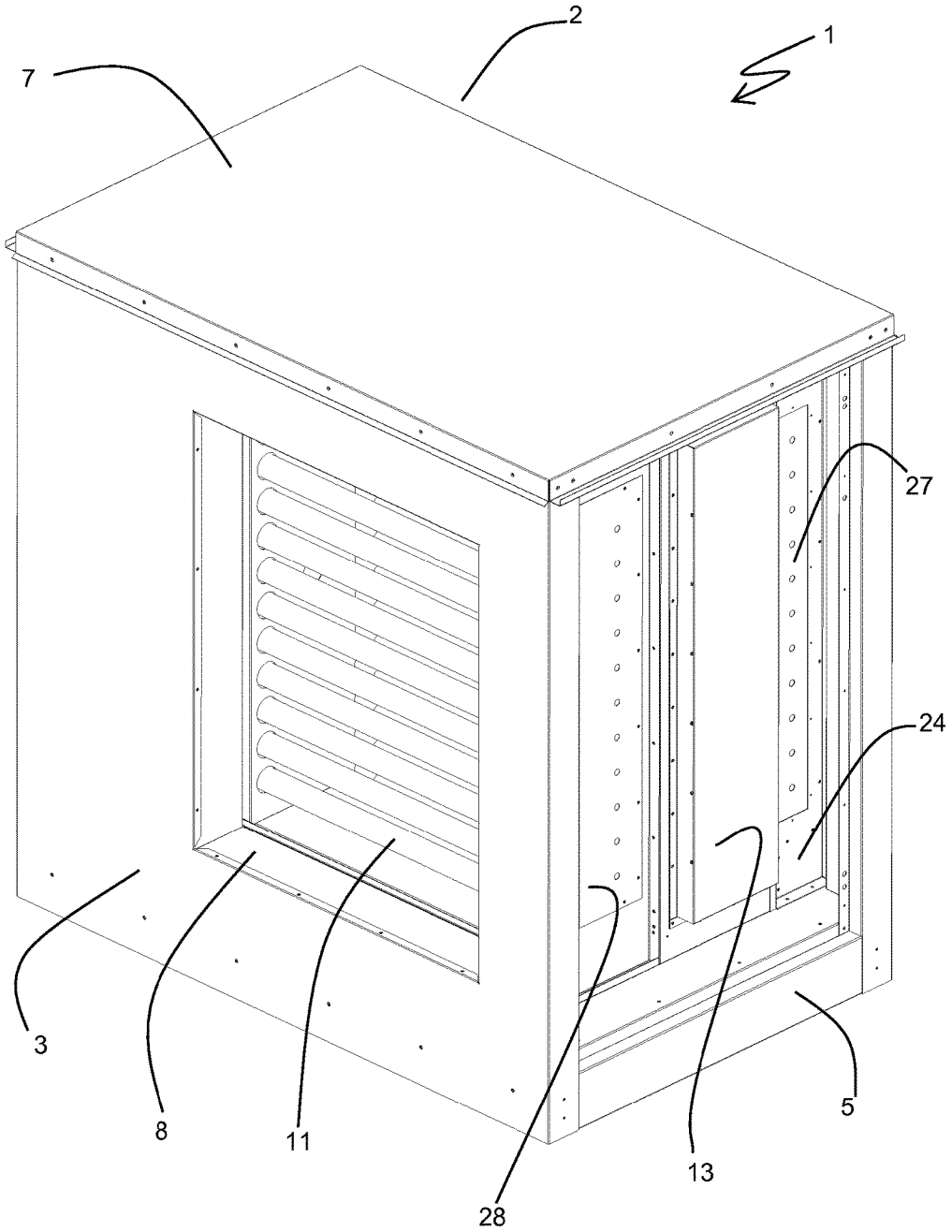
FIG. 2 is a perspective view of the furnace of FIG. 1, with a door removed to show selected internals of the furnace.

As shown in FIGS. 1A and 1B, the furnace 1 includes an enclosure 2 having an approximately boxlike shape and housing all of the internal componentry of the furnace 1. In some preferable embodiments the enclosure 2 is formed of sheet metal panels, and includes a top 7 and sides 3, 4, 5 and 6. Opposing sides 3 and 4 define an air outlet face and an air inlet face, respectively, and can be joined to appropriate ductwork in order to fluidly and structurally connect the furnace 1 into a heating duct or other mating sections including, but not limited to, a blower section or a downturn section (not shown). Opposing sides 5 and 6 extend between the inlet face 4 and the outlet face 3. A removable door 10 is provided within the face 5 to allow access to certain internal components of the furnace 1, as will be described. A similar door can be provided within the face 6, although such is not shown.

An air inlet 9 is provided as an aperture within the inlet face 4 to enable a flow of air 37 to enter the furnace 1 in order to be heated. The illustrated air inlet 9 is of a rectangular shape, although other shapes can be contemplated. Similarly, an air outlet 8 is provided as an aperture within the inlet face 4. The air outlet 8 is also of a rectangular shape, and is similar in size to the air inlet 9, although other shapes and sizes can be contemplated.

Figure 3:
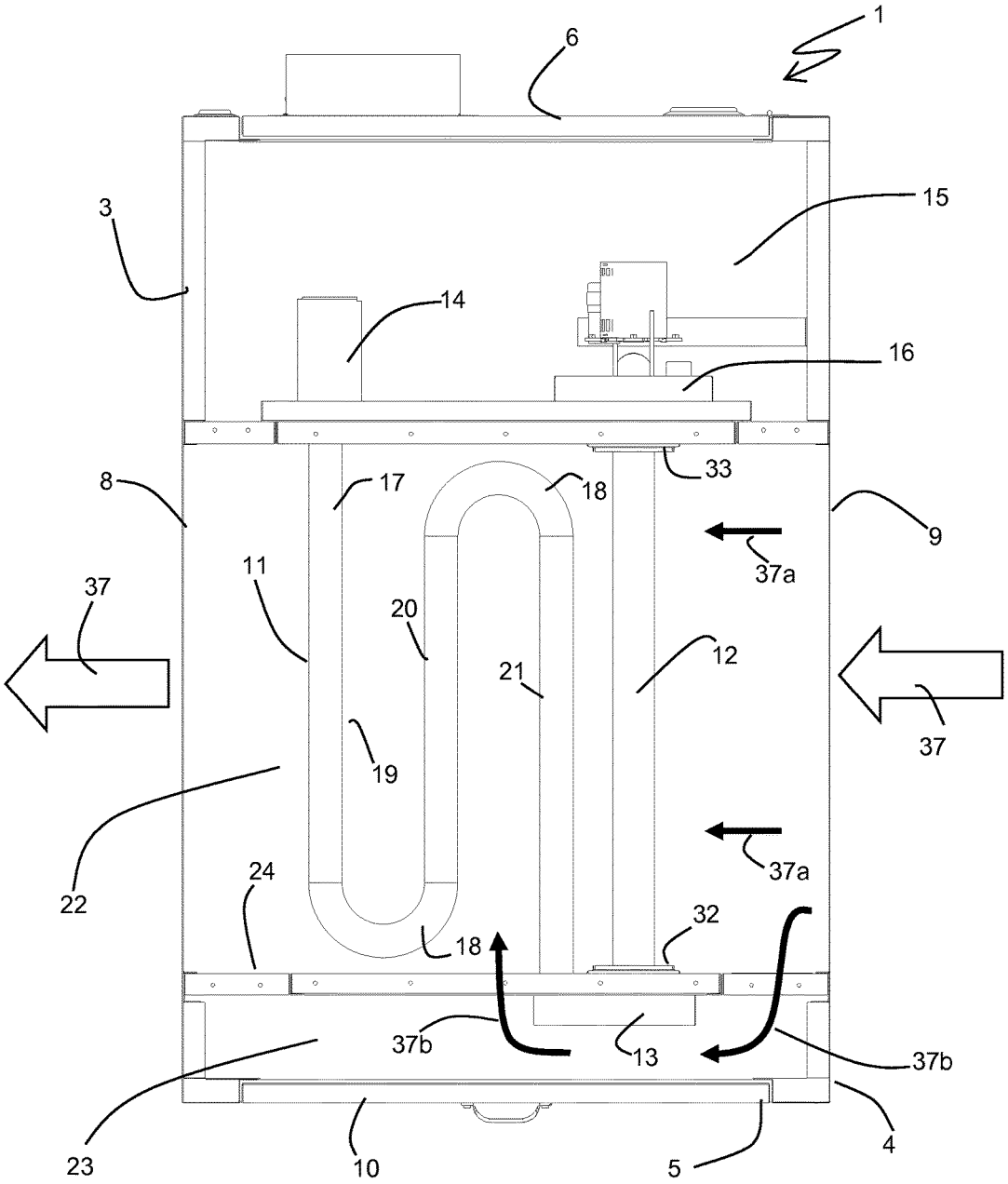
FIG. 3 is a plan view of the furnace of FIG. 1, with the top removed to show selected internals of the furnace.

Turning now to FIG. 3, it can be seen that the furnace 2 is sub-divided into three general sections: a control cabinet 15, a main air flow path 22, and an air bypass channel 23. The control cabinet 15 is arranged at that end of the furnace 1 which is bounded by the side 6, and it includes the burners 14, along with various electrical componentry such as control circuits, blowers, switches, and the like (all not shown). The main air flow path 22 is centrally located within the furnace 1, and extends between the air inlet 9 and the air outlet 8. The air bypass channel 23 is situated adjacent to the main air flow path 22, and is bounded by the side 5. A dividing plate 24 serves to separate the main air flow path 22 from the air bypass channel 23.

The main air flow path 22 includes a secondary heat exchanger 12 and a primary heat exchanger 11 arranged sequentially between the air inlet 9 and the air outlet 8. The primary heat exchanger 11 includes a plurality (twelve are shown) of steel tubes 17, each of which receives a flow of hot gases containing combustion products from a corresponding in-shot burner 14 arranged within the control cabinet 15. Each of the tubes 17 is bent into an S-shape to define three consecutive passes 19, 20, and 21 through the air flow path 22. U-shaped return bends 18 connect the first pass 19 to the second pass 20, and the second pass 20 to the third pass 21. The first pass 19 is arranged to be nearest to the air outlet 8, and the third pass 20 is arranged to be nearest to the air inlet 9, so that counter-current flow between the air passing from the air inlet 9 to the air outlet 8 and the combustion products passing through the primary heat exchanger 11 is achieved.

While a specific style of primary heat exchanger including bent circular tubes 17 is shown in the figures, other styles of primary heat exchangers for furnaces are also known, and could be readily substituted for the depicted primary heat exchanger 11. By way of example, a clamshell style heat exchanger such as is shown in U.S. Pat. No. 6,732,728 to Hill et al. could be used in the place of the primary heat exchanger 11.

The hot gases, having been substantially cooled in the primary heat exchanger 11, next pass once more through the main air flow path 22 in the secondary heat exchanger 12. The secondary heat exchanger 12 is preferably of a different construction from the primary heat exchanger 11. Details of the secondary heat exchanger 12 are best described with reference to FIG. 7, as the secondary heat exchanger 12 is shown without detail in FIGS. 1B, 3, 4 and 5.

In order to maximize the transfer of heat from the hot gases to the air, it becomes necessary to cool the combustion products down to a temperature closely approaching the temperature of the incoming air. This can be problematic for several reasons. First, the resulting minimal amount of temperature difference requires an increase in heat exchanger surface area, heat transfer coefficients, or both in order to efficiently transfer the required amount of heat. Second, cooling the hot gases down to such a low temperature inevitably results in condensation of water vapor contained in the combustion products. Such condensate tends to be corrosive to the metal alloys commonly used in the construction of heat exchangers, requiring the use of special materials in order to prevent corrosion damage.

Figure 7:
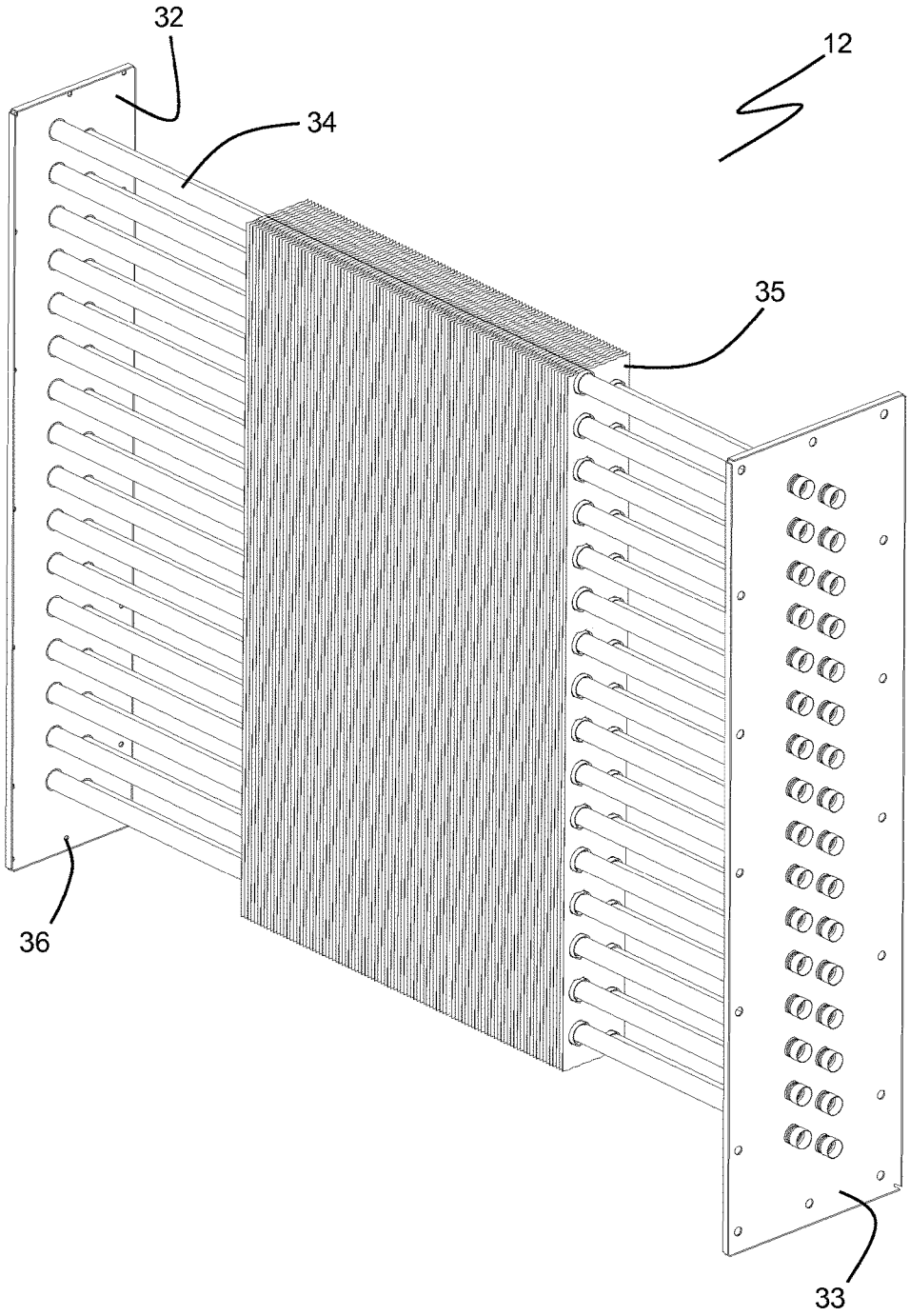
FIG. 7 is a perspective view of a heat exchanger for use in the furnace of FIG. 1.

In consideration of the foregoing, the exemplary secondary heat exchanger 12 as depicted in FIG. 7 includes an array of parallel arranged tubes 34 to convey the hot gases through the heat exchanger 12, the tubes 34 extending between header plates 32 and 33. In comparison to the primary tubes 17, the number of tubes 32 is increased, and their diameter is decreased, in order to effect the increase in heat exchanger efficiency that is necessary to compensate for the reduced temperature differential. By way of example, the exemplary heat exchanger 12 has a total of thirty-two tubes 34, more than two-and-a-half times the number (twelve) of primary tubes 17. The tubes 34 are preferably constructed of a corrosion-resistant material such as AL 29-4C®, a super-ferritic stainless steel available from Allegheny-Ludlum Corporation of Pittsburgh, Pa. Closely spaced plate fins 35 are arranged along the lengths of the tubes 34 in order to increase both the surface area and the heat transfer coefficient on the air side of the secondary heat exchanger 12. Only a selected portion of the complete pack of plate fins 35 are shown in FIG. 7, but it should be understood that the plate fins 35 are present along the full length of the heat exchanger between the header plates 32, 33. Contact between the tubes 34 and the plate fins 35 can be provided through mechanical expansion of the tubes 34, or alternatively through a metallurgical bonding process. Joints between the tube 34 and the headers 32 and 33 can be similarly achieved.

A collection/discharge box 13 is located within the air bypass channel 23, and fluidly connects the outlet of the third pass 21 of the primary heat exchanger 11 to the secondary heat exchanger 12 for routing of the hot gases between the two. The collection/discharge box 13 is of a bent sheet-metal construction, and is joined to the dividing plate 24 in order to maintain separation between the air passing through the air bypass channel 23 and the combustion products. Similarly, an outlet box 16 is arranged within the control cabinet 15 and receives the fully cooled gases from the secondary heat exchanger 12, after which the combustion products (as well as any condensate produced within the secondary heat exchanger 12) can be removed from the furnace 1.

The dividing plate 24 extends between the air inlet 9 and the air outlet 8, and in the specific embodiment illustrated in FIG. 3 the dividing plate 24 is approximately coplanar with an edge of each of the air inlet 9 and the air outlet 8. Such an alignment can be advantageous in some instances, as it prevents disruptions in the air flow that may otherwise be caused by a sudden expansion or contraction of the flow area within the main air flow path 22.

In order to allow for a portion 37*b* of the air flow 37 entering into the furnace 1 through the air inlet 9 to pass through the bypass channel 23, an array of inlet apertures 25 is provided in the dividing plate 24 between the air inlet 9 and the secondary heat exchanger 12. Since the secondary heat exchanger 12, with its array of plate fins 35, can impose a substantial pressure drop on the air passing through the secondary heat exchanger 12, some portion 37*b* of the incoming air can be guaranteed to pass through the air bypass channel 23 in order to balance the pressure drops, with the remainder 37*a* of the air flow 37 continuing on through the main air flow path 22. The portion 37*b* of the air is re-introduced to the main air flow path 22 through an array of outlet apertures 26 arranged between the collection/discharge box 13 and the air outlet 8. The re-combined air flow 37 continues on through the remainder of the main air flow path 22, and exits from the furnaces 1 through the air outlet 8.

When the primary heat exchanger 11 consist of multiple passes (such as the three passes 19, 20 and 21 of the exemplary embodiment), then the portion of the air 37*b* can be allowed to flow over one or more of the passes after having been recombined with the portion 37*a* of the air flow, so that any undesirable dilution of fully heated air with relatively unheated air is avoided. However, it may be desirable, in other embodiments, for the outlet apertures 26 to be arranged entirely between the primary heat exchanger 11 and the air outlet 8.

Figure 4:
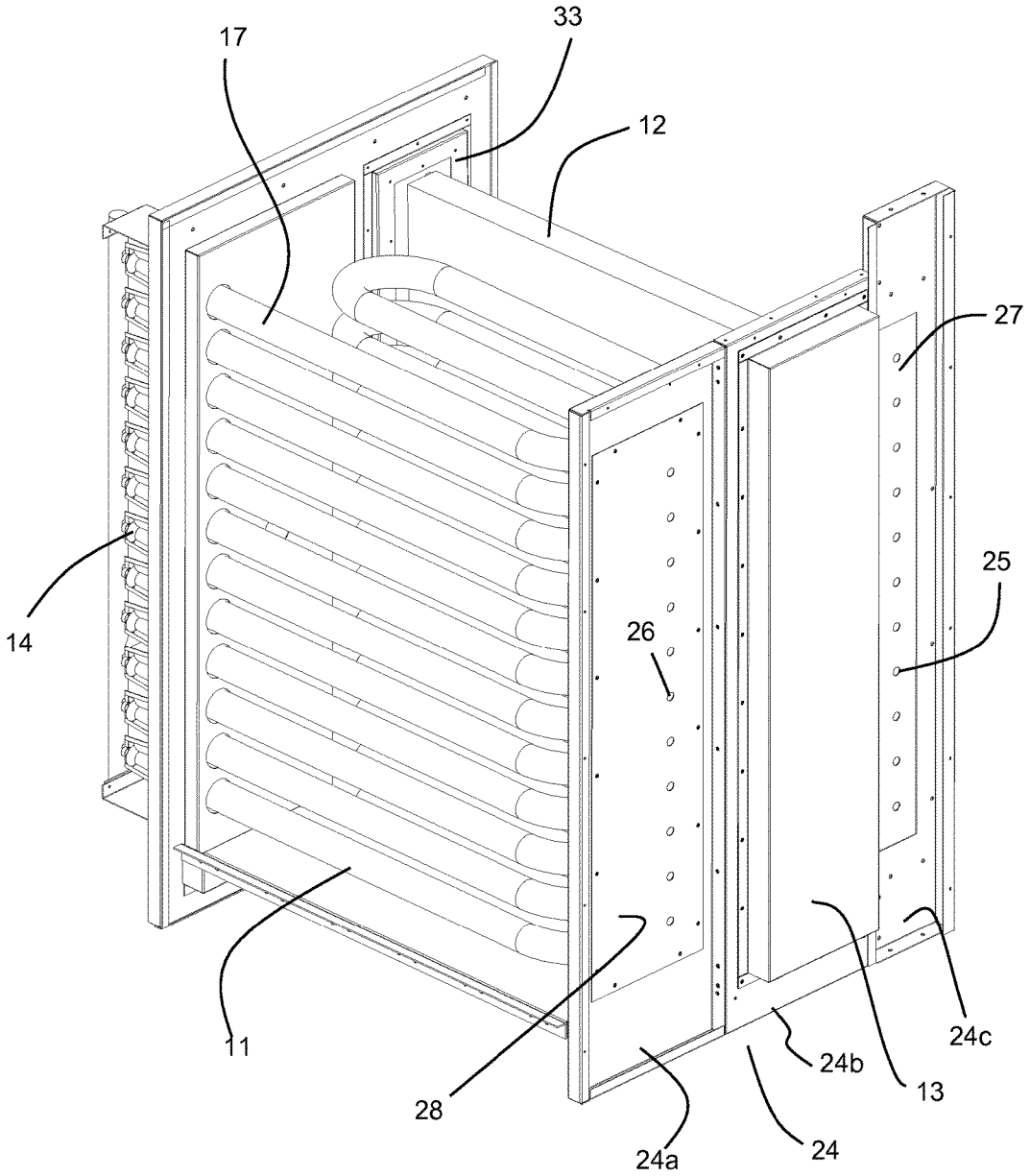
FIG. 4 is a perspective view of selected internal components of the furnace of FIG. 1.
Figure 6:
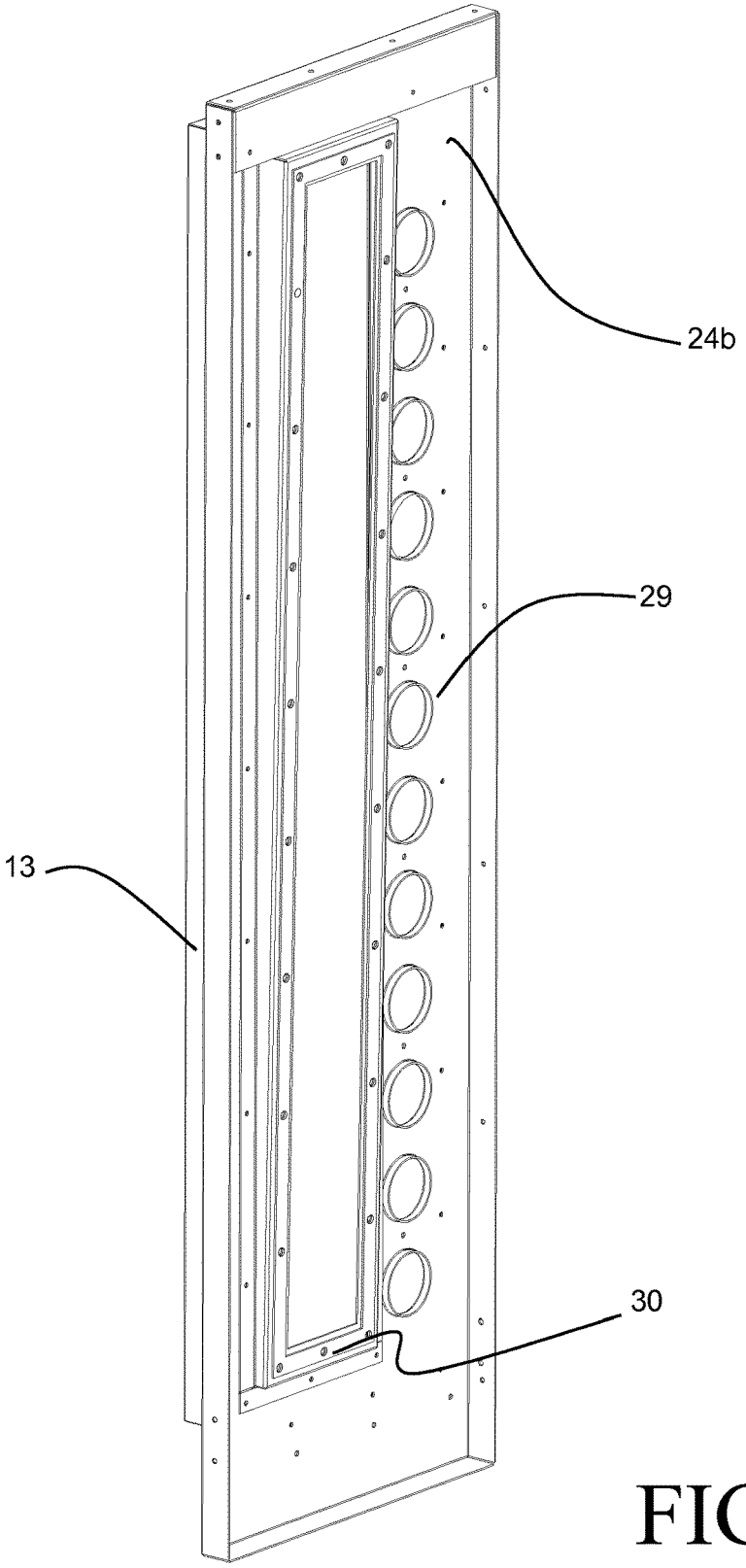
FIG. 6 is a perspective view of certain of the components of FIG. 4.

As shown in FIG. 4, the dividing plate 24 can optionally be constructed of multiple pieces. By way of example, a central piece 24*b* (shown in detail in FIG. 6) can be provided with openings 29 to receive the ends of the tubes 17 of the primary heat exchanger 11, as well as with a mounting face 30 to which the header 32 of the secondary heat exchanger 12 can be mounted (such as by the use of mechanical fasteners joining the two through corresponding mounting holes 36). The collection/discharge box 13 can additionally be mounted to the piece 24*b*, and the piece 24*b* and collection./discharge box 13 can thus be part of a combined heat exchanger assembly that includes both the primary and secondary heat exchangers 11, 12. Additional pieces 24*a* and 24*c* are joined to the piece 24*b* in order to form the complete dividing plate 24 within the furnace 1. As a result, the collection/discharge box 12 separates the plate piece 24*a* and the plate piece 24*c*. Furthermore the inlet apertures 25 can be located within an inlet sub-plate 27 of the dividing plate 24, and likewise the outlet apertures can be located within an outlet sub-plate 28 of the dividing plate 24. The sub-plate(s) 27 and/or 28 can be made to be removable so that routine cleaning or maintenance of the heat exchangers can be performed through the access door 10 once the furnace 1 is installed.

The portion 37*b* of the air passing through their bypass channel 23 provides the additional benefit of cooling the collection/discharge box 13, thereby preventing or reducing the radiation of heat from the collection/discharge box 13 to the door 10 or side 5 of the furnace 1. In this manner, a suitably low surface temperature can be maintained on the outer, user-accessible portions of the furnace 1 without requiring a large physical separation between the collection/discharge box 13 and the outer wall of the furnace 1, thus enabling a more compact furnace. Compactness is further enhanced by placing the dividing plate 24 immediately adjacent to the bends 18 connecting the passes 19 and 20 of the primary heat exchanger 11. The heat transfer efficiency from the combustion products flowing through the primary heat exchanger 11 can thus be enhanced without the need for air baffles to prevent any undesirable bypass around the primary heat exchanger 11. The placement of the dividing plate 24 between the bends 18 and the enclosure 2 prevents the outer surfaces of the furnace 1 from being heated to unacceptable temperatures by the hot bends 18.

Figure 5:
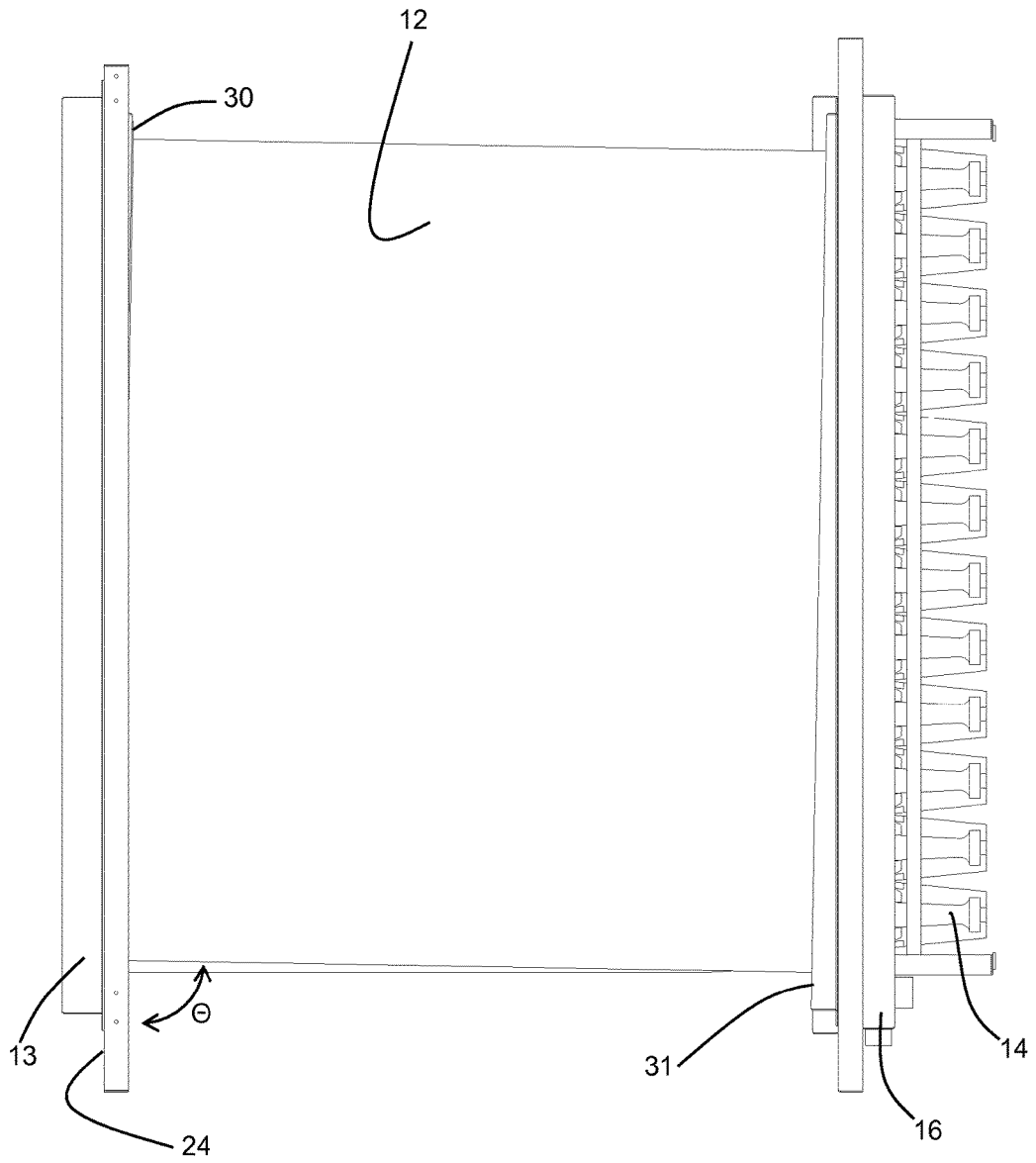
FIG. 5 is an elevation view of the selected internal components of FIG. 4.

As best shown in FIG. 5, the secondary heat exchanger 12 can be mounted within the furnace 1 so that the tubes 34 are inclined at an angle Θ that is slightly less than perpendicular to vertical. This slight downwardly sloping angle ensures that any condensate produced within the secondary heat exchanger 12 is promptly removed from the tubes 34. Turning again to FIG. 6, it can be seen that this slight incline from perpendicular is accomplished by orienting the mounting face 30 to be slightly inclined from the dividing plate 24. Likewise, the corresponding mounting face for the opposing header of the secondary heat exchanger 12 can be similarly inclined, so that the secondary heat exchanger 12 itself can be of a construction where the headers 32 and 33 are essentially perpendicular to the axes of the tubes 34.

Although the exemplary embodiments shown and described route the hot gases and the air through the furnace 1 in a counter-current fashion, in some embodiments it may be preferable to instead route the same in a co-current fashion. This can be readily accomplished by reversing the direction of the air flow 37 through the furnace 1, so that the air outlet 8 becomes the air inlet, and the air inlet 9 becomes the air outlet. Similarly, the functionality of the apertures 25 and 26 would be reversed, so that the apertures 26 would provide for entry of the flow portion 37*b* into the air bypass channel 23, and the flow portion 37*b* would pass back from the air bypass channel 23 into the main air flow path 22 through the apertures 25.

Various alternatives to the certain features and elements of the present invention are described with reference to specific embodiments of the present invention. With the exception of features, elements, and manners of operation that are mutually exclusive of or are inconsistent with each embodiment described above, it should be noted that the alternative features, elements, and manners of operation described with reference to one particular embodiment are applicable to the other embodiments.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention.

We claim:

1. A method of heating air using hot gases, comprising:

directing the hot gases through a primary heat exchanger, receiving the hot gases from the primary heat exchanger into a collection/discharge box, and directing the hot gases from the collection/discharge box through a secondary heat exchanger;

receiving a flow of air into a furnace enclosure housing the primary heat exchanger, collection/discharge box, and secondary heat exchanger;

diverting a portion of the air through a bypass channel to bypass at least a portion of the primary heat exchanger and the secondary heat exchanger;

passing the diverted air over the collection/discharge box to receive heat from the hot gasses within the collection/discharge box;

passing the un-diverted air over the primary and the secondary heat exchanger to receive heat from the hot gases flowing through said heat exchangers;

recombining the heated diverted air and the heated un-diverted air;

removing the recombined air from the furnace enclosure; and passing the diverted air over at least a portion of the primary heat exchanger after recombining the diverted air and the un-diverted air.

2. The method of claim 1, wherein passing the un-diverted air over the primary and the secondary heat exchanger comprises passing said air over the secondary heat exchanger prior to passing said air over the primary heat exchanger.

3. The method of claim 1, wherein diverting a portion of the air through a bypass channel includes directing said portion of the air from a first side of a dividing plate bounding the bypass channel to a second, opposing side of the dividing plate.

4. The method of claim 3, further comprising directing the diverted air through a plurality of apertures arranged in the dividing plate.

5. The method of claim 1, wherein directing the hot gases through a primary heat exchanger includes directing the hot gases through a plurality of flow passes, the flow passes being arranged in one of a co-current and a counter-current orientation to the air passing over the primary heat exchanger.

6. A furnace for heating air, comprising:

a primary heat exchanger to transfer heat from a flow of hot gases;

a secondary heat exchanger to transfer heat from said flow of hot gases, arranged downstream from the primary heat exchanger with respect to the hot gas flow;

a collection/discharge box fluidly coupling an outlet of the primary heat exchanger and an inlet of the secondary heat exchanger;

an enclosure housing the primary heat exchanger, the secondary heat exchanger, and the collection/discharge box, the enclosure having an air inlet and an air outlet;

a main air flow path extending through the enclosure from the air inlet to the air outlet, the primary heat exchanger and the secondary heat exchanger being arranged along the main air flow path; and an air bypass channel arranged to be fluidly parallel to a section of the main air flow path, the collection/discharge box being arranged within the bypass channel.

7. The furnace of claim 6, wherein the bypass channel includes an inlet at a first location along the main air flow path and an outlet at a second location along the main air flow path, the first location being between the secondary heat exchanger and one of the air inlet and the air outlet, and the second location being between at least a portion of the primary heat exchanger and the other of the air inlet and the air outlet.

8. The furnace of claim 6, further comprising a dividing plate located within the enclosure, the dividing plate separating the bypass channel from the main air flow path.

9. The furnace of claim 8, further comprising a plurality of apertures extending through the dividing plate to fluidly join the bypass channel and the main air flow path.

10. The furnace of claim 9, wherein at least some of the plurality of apertures are provided at a location along the main air flow path between the secondary heat exchanger and one of the air inlet and the airoutlet.

11. The furnace of claim 9, wherein at least some of the plurality of apertures are provided at a location along the main air flow path between the air outlet and at least a portion of the primary heat exchanger.

12. The furnace of claim 9, wherein at least some of the plurality of apertures are provided at a location along the main air flow path between the air inlet and both the primary and secondary heat exchangers.

13. The furnace of claim 6, wherein the bypass channel is at least partially bounded by an outer wall of the enclosure.

14. The furnace of claim 8, wherein the dividing plate abuts the collection/discharge box.

15. The furnace of claim 8, wherein the dividing plate includes a first plate piece and a second plate piece, the collection/discharge box being located between the first and second plate pieces.

16. The furnace of claim 8, wherein the primary heat exchanger comprises: a first exhaust pass extending through the main air flow path;

a second exhaust pass extending through the main air flow path; and a return bend joining the first and second exhaust passes, outermost extents of the return bend being arranged immediately adjacent to the dividing plate.

17. The furnace of claim 8, further comprising a plurality of apertures extending through the dividing plate to fluidly join the bypass channel and the main air flow path, at least some of the plurality of apertures being provided at a location along the main air flow path between the air inlet and at least one of the primary and secondary heat exchangers.

18. The furnace of claim 17, wherein at least some of the plurality of apertures are provided at a location along the main air flow path between the air outlet and at least a portion of the primary heat exchanger.

19. The furnace of claim 8, wherein the dividing plate is coplanar with an edge of the air inlet and with an edge of the air outlet.

* * * * *